United States Patent [19]

Tidwell

[11] Patent Number: 5,016,918

[45] Date of Patent: May 21, 1991

[54] APPARATUS AND METHOD FOR TRANSMITTING A MESSAGE

[76] Inventor: Doug E. Tidwell, 8330 N. 19 Ave. #2126, Phoenix, Ariz. 85021

[21] Appl. No.: 377,054

[22] Filed: Jul. 10, 1989

[51] Int. Cl.[5] ..... B42D 15/00

[52] U.S. Cl. ..... 283/67; 273/162 C; 283/81; 283/117

[58] Field of Search ..... 273/162 C; 283/81, 101, 283/74, 67, 117

[56] References Cited

U.S. PATENT DOCUMENTS

| | | | |
|---|---|---|---|
| 257,136 | 4/1882 | Livor | 283/81 |
| 1,145,367 | 7/1916 | Herter | 283/81 |
| 2,069,609 | 2/1937 | Hanson | 283/81 |
| 3,750,317 | 8/1973 | Morgan | 283/81 |
| 4,241,917 | 12/1980 | Cohen | 273/162 C |
| 4,312,523 | 1/1982 | Haines | 283/81 |

*Primary Examiner*—Paul A. Bell

*Attorney, Agent, or Firm*—Don J. Flickinger; Jordan M. Meschkow

[57] ABSTRACT

An elongate flexible sheet member having a message imprinted thereon is encoiled about an object to be transmitted from a sender to a receiver. Pressure sensitive adhesive secures the first end of the sheet member to the object and secures the final coil to the penultimate coil. Tab, which may carry and encodement to identify the message extends from the final coil and serves to remove the sheet member. In a exemplary embodiment, the sheet member carries a joke pertaining to golf and is spirally wound about the shank of a golf tee.

6 Claims, 1 Drawing Sheet

APPARATUS AND METHOD FOR TRANSMITTING A MESSAGE

BACKGROUND OF THE INVENTION

1. Field of the Invention

This invention relates to the transmission of written messages.

More particularly, the present invention relates to means for including a message with a transmittable object.

In a further and more specific aspect, the instant invention concerns an indicia bearing sheet member which is detachably receivable securable to a selected object.

2. The Prior Art

The art is replete with various means for coupling a written message to an object for transmission from a sender to a receiver. Frequently, the message is inscribed on a sheet member, such as a strip of paper or metal. Various specialized means are employed for combining the sheet member with the object.

An exemplary means of coupling a message with a object is the familiar attachment of an identification tag to an item of hardware by adhesive bonding or mechanical fasteners. Equally well-known is containing the sheet member and the object in a common package, as exemplified by the inclusion of a coupon in a container of a consumer product. Also familiar is the use of the object as a vessel for containing the sheet member, as exemplified by the notorious Chinese fortune cookie.

Not contemplated by the prior art, however, is the coupling of a message bearing sheet to a particular class of objects. This is especially noted in connection with objects to which it is desirable to attach a sheet member and from which the sheet member must be removed prior to use. The neglect is even further emphasized wherein the object is not readily suitable for the securement of a sheet member.

Particularly ignored by the prior art is the detachable securement of a message bearing sheet member to a slender elongate object wherein the sheet member is of substantial size relative the object and compactness of the coupled product must be observed. Exemplary is the attachment of a message to a golf tee. The tee is a relatively diminutive object. Yet in order to carry an easily readable message of nominal length, the sheet member must be of substantial size. It is desirable that the sheet member be easily removed prior to use of the tee. As a further imposition, the tee and the sheet member must present a compact package from which the sheet member is not readily displaceable.

It would be highly advantageous, therefore, to remedy the foregoing and other deficiencies inherent in the prior art.

Accordingly, it is an object of this invention to provide improvements in the transmission of written messages.

Another object of the invention is the provision of improved means for including a written message with an object for transmission from a sender to a receiver.

Still another object of the invention is to provide improved means for detachably securing an indicia bearing sheet member to an object.

Yet another object of the immediate invention is the provision of means for coupling a relatively large sheet member to a relatively small object.

And yet another object of the invention is to provide means whereby a coupled sheet member and object provide a compact unit for convenient stowage.

Yet still another object of the invention is the provision of means whereby the sheet member is easily removable from the object but not readily susceptible to accidental dislodgement.

A further object of the instant invention is to provide means for transmitting a hidden message which is revealed upon removal of the sheet member from the object.

And a further object of the invention is the provision of novel means for encoiling an elongate sheet member about an elongate slender object.

Still a further object of the invention is to provide method whereby the foregoing means are conveniently accomplished.

And yet a further object of invention is the provision of means and method according to the foregoing which can be simply practiced with conventional materials and skills.

SUMMARY OF THE INVENTION

Briefly, to achieve the desired objects of the instant invention in accordance with a preferred embodiment thereof, first provided is an elongate flexible sheet member carrying indicia on one side thereof for displaying a selected message. Next provided are attachment means for detachably securing the sheet member to the shank of a transmittable object.

In accordance with a more specific embodiment of the invention, the attachment means holds the sheet member in a plurality of successive coils spirally encircling the shank of the object. Preferably, the attachment means includes first adhesive means for releasably the securing sheet member, proximate one end thereof, to the shank of the object. Second adhesive means secures the last coil of the spirally encircling sheet member to a penultimate coil. Alternately, the sheet member may be provided with a free terminal portion extending beyond the second adhesive means. Ancillary indicia, such as an encodement of the message, may be carried on the terminal portion.

Also provided by the instant invention is a method of preparing a message for transmission comprising the steps of inscribing the message on an elongate sheet member and spirally affixing the sheet member to a transmittable object. The step of spirally affixing includes the sub-steps of attaching the sheet member proximate the first end thereof to an object, coiling the sheet member about the object and restraining the sheet member proximate the second end thereof. The sub-step of attaching includes applying a strip of adhesive laterally along the flexible sheet member and the sub-step of restraining includes securing a portion of said sheet member proximate the second thereof to an intermediate portion.

BRIEF DESCRIPTION OF THE DRAWINGS

The foregoing and further and more specific objects and advantageous of the instant invention will be readily apparent to those skilled in the art from the following detailed description of a preferred embodiment thereof taken in conjunction with the drawings in which the several figures sequentially describe a method and in which.

DETAILED DESCRIPTION OF THE PREFERRED EMBODIMENT

Figures 1, 2, 3, 4, 5, 6, 7, 8:
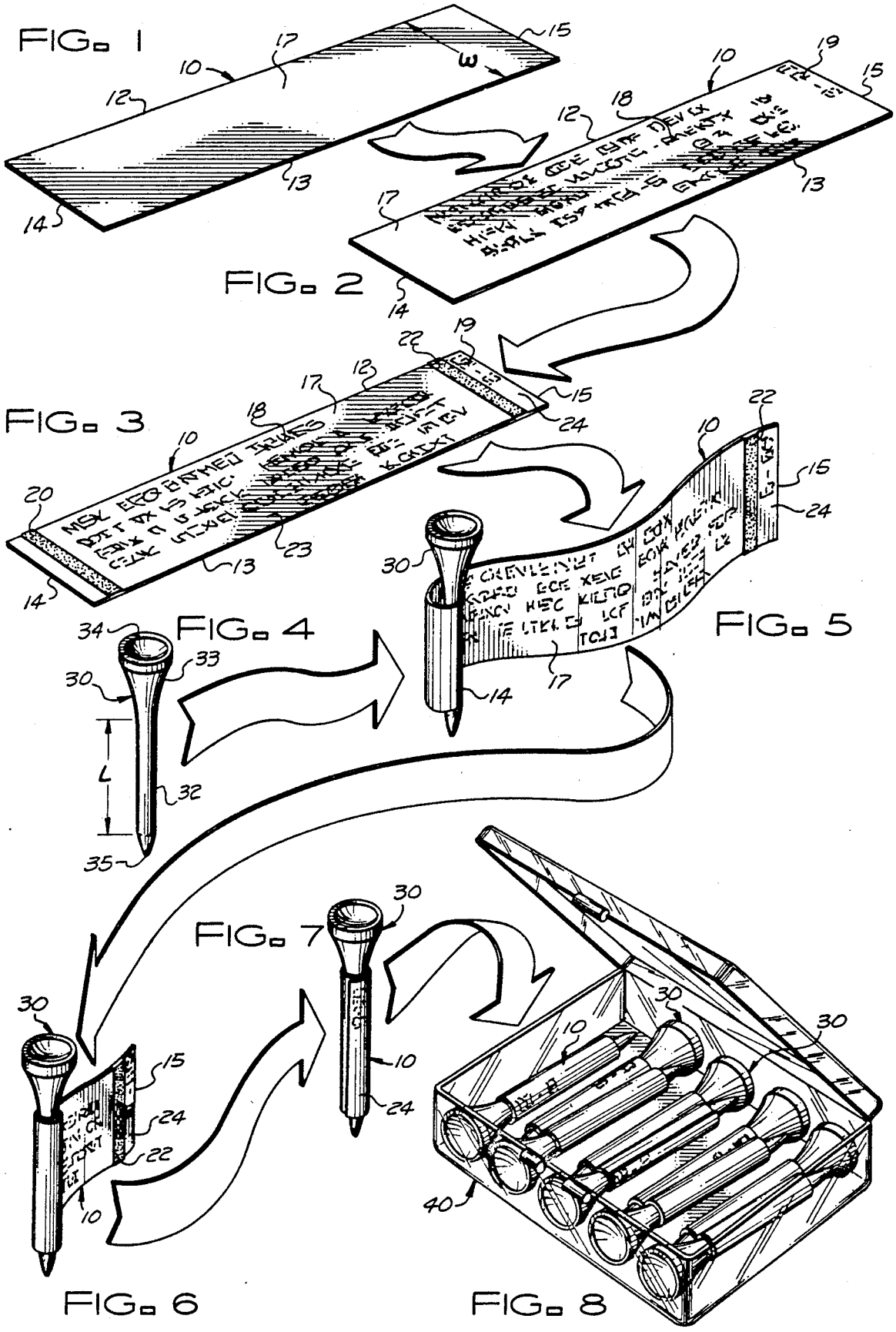
FIG. 1 is a perspective view of a flexible sheet member useful in connection with practicing the instant invention.
FIG. 2 is a view generally corresponding to the illustration of FIG. 1 and illustrating the sheet member thereof as it would appear after having indicia printed on one side thereof.
FIG. 3 is a view generally corresponding to the view of FIG. 2 and illustrating the sheet member after further preparation by the application of an adhesive.
FIG. 4 is a perspective view of a transmittable object, therein chosen for purposes of illustration as a golf tee.
FIG. 5 is a perspective view showing an initial step in the attachment of the flexible sheet of FIG. 3 to the golf tee of FIG. 4.
FIG. 6 is a view generally corresponding to the view of FIG. 5 and showing a subsequently intermediate step in the attachment of the sheet member to the golf tee.
FIG. 7 is a view generally corresponding to the illustration of FIG. 6 and specifically illustrating the sheet member as it would appear after having been attached to the golf tee.
FIG. 8 is a perspective view of several of the devices seen in FIG. 7 as they would appear when placed in a container.

Turning now to the drawing in which like reference characters indicate corresponding elements throughout the several views, attention is first directed to FIG. 1 which shows a sheet member, generally designated by the reference character 10, having first longitudinal edge 12, second longitudinal edge 13 and first and second ends 14 and 15, respectively, which define the surface of side 17. Sheet member 10 further includes a width defined by the dimension line designated W which is the lateral distance between edges 12 and 13. In accordance with the immediately preferred embodiment of the invention, sheet member 10 is elongate. As will be appreciated by those skilled in the art, however, sheet member 10 is intended to be representative of any flexible sheet member fabricated of paper, foil or other well-known material.

Indicia 18, displaying a selected message as seen in FIG. 2, is inscribed upon side 17. Ancillary indicia 19, as such an encodement, may be inscribed upon a terminal portion of sheet member 10 adjacent second edge 15. Further description of the indicia, which can be readily imprinted in accordance with any standard prior art technique, will be made as the description process.

As seen with reference to FIG. 3, first and second strips of adhesive 20 and 22, respectively, are placed upon side 17 of sheet member 10. Each strip of adhesive extends lateral of sheet member 10. Preferably, the first strip of adhesive 20 is placed proximate first end 14. The second strip of adhesive 22 is placed intermediate indicia 18 and ancillary indicia 19 thereby dividing side 17 into a first field 23 containing the indicia 18 and a second field 24 which is the terminal portion of sheet member 10 adjacent second end 15 and carrying the ancillary indicia 19. Sheet member 10 is now prepared for attachment to a selected object which is transmittable from a sender to a receiver.

An illustrative transmittable object, chosen for purposes of illustration in accordance with the teachings of the instant invention, is a conventional golf tee generally designated by the reference character 30 as seen in FIG. 4. Being a conventional prior art device, golf tee 30 includes an elongate cylindrical shank 32 having a length represented by the dimension line designated L. Enlarged head 33 having concave end surface 34 for supporting a golf ball is carried at one end of shank 32. At the other end, shank 32 terminates with pointed end 35 for purposes of penetrating the earth. In accordance with conventional procedure, golf tee 30 may be fabricated of wood, plastic, or other selected material. Further and more specific details of conventional prior art golf tees will readily occur to those skilled in the art.

In accordance with the immediately preferred embodiment of the instant invention, adhesive strip 20 is positioned against and in alignment with the longitudinal axis of shank 32 as seen in FIG. 5. Sheet member 10 is then spirally wound in coils about tee 30 as represented by the illustration of FIG. 6. The winding of sheet member 10 about golf tee 30 continues until second adhesive strip 22, carried by the terminal coil, is affixed to the penultimate coil to produce the finished apparatus illustrated in FIG. 7. It is noted that the terminal portion 24 is free to function as a pull tab to facilitate removal of sheet member 10 from golf tee 30.

In accordance with the embodiment of the invention herein previously described, indicia 18 is preferably in the form of a joke or other message related to the game of golf. Sheet member 10 is removed to display the previously hidden message immediately prior to the use of golf tee 30. For the immediate purpose, it is preferred that strips 20 and 22 be of a pressure sensitive adhesive such as the low fiber tear pressure sensitive adhesive distributed by National Casein under the designation 2M54. To provide a compact unencumbered package, it is preferred that the width W of sheet member 10 have a dimension which is not greater than the length L of shank 32.

Golf tees are considered to be a disposable item. The average golfer may use several during a single game. Accordingly, several tees 30 having sheet members 10 secured thereto, as seen in FIG. 7, may be placed in a container 40 as illustrated in FIG. 8. Container 40 is intended to be representative of any typical prior art packaging means. It is preferred that a selected number of units be positioned within a single container. The selected number of units may be considered to be a series, each of which carries a different message. Ancillary indicia 19 functions as an encodement for the convenience of the distributor or of the repeat buyer. For example, units within a first container may be designated by the code 1-1, 1-2, 1-3, etc. The first number of the code indicating the series while the second refers to a specific message. Accordingly, the units in a second container would be encoded 2-1, 2-2, 2-3, etc. Consistent with the immediately preferred embodiment of the instant invention, the receiver of the message is the player of the game while the sender may be considered the giver of a gift or the factory.

Various changes and modifications to the embodiment of the invention herein chosen for purposes of illustration will readily occur to those skilled in the art. To the extent that such modification and variations do not depart from the spirit of the invention, they are intended to be included within the scope thereof which is accessed only by a fair interpretation of the following claims.

Having fully described and disclosed the instant invention in such clear and concise terms as to enable those skilled in the art to understand and practice the same, the invention claimed is:

1. An apparatus especially adapted for use with a transmittable object having an elongate shank of predetermined length and circumference and for transmitting a selected message therewith, said apparatus comprising:

(a) an elongate flexible sheet member having a width not greater than said predetermined length and a length substantially greater than said predetermined circumference, said sheet member including
(i) a first side having indicia printed thereon for displaying said message,
(ii) a second side,
(iii) a first end, and
(iv) a second end; and (b) attachment means for detachably securing said sheet member in a spiral configuration comprising a plurality of coils around the shank of the object, with said first side of said sheet member facing the shank such that the indicia on said first side is hidden from view, said attachment means including
(i) first low tack adhesive means carried on said first side of said sheet member proximate the first end thereof for releasably securing said first end to the shank of the object; and
(ii) second low tack adhesive means carried on said first side of said sheet member proximate the second end thereof for releasably securing a terminal coil of said sheet member to a penultimate coil.

2. The apparatus of claim 1, wherein said second side of said sheet member is blank.

3. The apparatus of claim 1, wherein said second adhesive means is spaced from the second end of said sheet member to define a free terminal intermediate said second adhesive means and said second end.

4. The apparatus of claim 3, further including ancillary indicia carried on the free terminal intermediate portion of said sheet member.

5. A method of transmitting a message to a golfer, comprising the steps of:

(a) providing a golf tee having a shank of predetermined length and circumference;
(b) inscribing said message on an elongate sheet member having a first side, a second side, a first end, and a second end with said sheet member further having a width not greater than said predetermined length and a length substantially greater than said predetermined circumference;
(c) applying a low tack, pressure-sensitive adhesive to said first side of said sheet member proximate the first and second ends thereof;
(d) releasably securing the first end of said sheet member to said shank of said golf tee by pressing said adhesive proximate said first end against said shank;
(e) coiling said sheet member a plurality of times about said shank in a direction such that said first side faces said shank; and
(f) releasably securing a terminal coil of said sheet member to a penultimate coil thereof by pressing said adhesive proximate said second end against said penultimate coil.

6. The method according to claim 5, wherein said step of inscribing said message further comprises inscribing said message on at least one of said first and second sides of said sheet member.

* * * * *